United States Patent [19]

Dragone

[11] Patent Number: 5,039,993

[45] Date of Patent: Aug. 13, 1991

[54] PERIODIC ARRAY WITH A NEARLY IDEAL ELEMENT PATTERN

[75] Inventor: Corrado Dragone, Little Silver, N.J.

[73] Assignee: AT&T Bell Laboratories, Murray Hill, N.J.

[21] Appl. No.: 440,825

[22] Filed: Nov. 24, 1989

[51] Int. Cl.[5] ..... H01Q 13/00

[52] U.S. Cl. ..... 343/776; 343/786

[58] Field of Search ..... 343/776, 786, 772, 909

[56] References Cited

U.S. PATENT DOCUMENTS

| | | | |
|---|---|---|---|
| Re. 23,051 | 11/1948 | Carter | 343/786 |
| 2,920,322 | 1/1960 | Brown Jr. | 343/776 |
| 3,243,713 | 3/1966 | Brahm | 343/776 |
| 3,977,006 | 8/1976 | Miersch | 343/853 |
| 4,259,674 | 3/1981 | Dragone et al. | 343/909 |
| 4,369,413 | 1/1983 | Devan et al. | 333/34 |
| 4,737,004 | 4/1988 | Amitay et al. | 350/96.15 |
| 4,878,059 | 10/1989 | Yukl | 343/756 |

FOREIGN PATENT DOCUMENTS

| | | | |
|---|---|---|---|
| 60-196003 | 10/1985 | Japan | 343/776 |

OTHER PUBLICATIONS

"Theory & Analysis of Phased Array Antennas", N. Y. Wiley, Publisher, 1972, Introduction to array Theory, N. Amitay et al., pp. 10–14.

"Efficient Multichannel Integrated Optics Star Coupler on Silicon", IEEE Photonics Technology Letters, vol. 1, No. 8, Aug. 1989, C. Dragone et al., pp. 241–243.

*Primary Examiner*—Michael C. Wimer

*Assistant Examiner*—Hoanganh Le

*Attorney, Agent, or Firm*—Eli Weiss

[57] ABSTRACT

A waveguide array comprising a plurality of waveguides which are each outwardly tapered at the aperture of the array in accordance with a predetermined criteria chosen to increase waveguide efficiency. The tapering serves to gradually transform a fundamental Bloch mode, propagating through the waveguide array, into a plane wave in a predetermined direction, and then to launch the plane wave into free space in the predetermined direction. In another embodiment, the waveguides are positioned relative to one another in order to satisfy the predetermined criteria.

7 Claims, 6 Drawing Sheets

PERIODIC ARRAY WITH A NEARLY IDEAL ELEMENT PATTERN

BACKGROUND OF THE INVENTION

1. Field of the Invention

This invention relates to waveguides, and more particularly, a technique for maximizing the efficiency of an array of waveguides.

2. Description of the Prior Art

Waveguide arrays are used in a wide variety of applications such as phased array antennas and optical star couplers. FIG. 1 shows one such waveguide array comprising three waveguides 101–103 directed into the x–z plane as shown. The waveguides are separated by a distance "a" between the central axis of adjacent waveguides, as shown. A figure of merit for such a waveguide array is the radiated power density $P(\theta)$ as a function of $\theta$, the angle from the z-axis. This is measured by exciting one of the waveguides in the array, i.e. waveguide 102, with the fundamental input mode of the waveguide, and then measuring the radiated pattern. Ideally, it is desired to produce a uniform power distribution as shown in ideal response 202 of FIG. 2, where $(\gamma)$ is specified by the well-known equation $$[a] \sin(\gamma) = \lambda/2, \tag{1}$$

where $\lambda$ is the wavelength of the radiated power in the medium occupying the positive z plane of FIG. 1. The angular distance from $-\gamma$ to $\gamma$ is known as the central Brillouin zone. In practice, it is impossible to produce ideal results. An exemplary response from an actual array would look more like typical actual response 201 of FIG. 2. The efficiency of the array, $N(\theta)$, when one waveguide is excited, is the ratio of the actual response divided by the ideal response, for all $\theta$ such that $-\gamma \leqq \theta \leqq \gamma$. Of course, this neglects waveguide attenuation and reflection losses. With this background, the operation of phased array antennas is discussed below.

The operation of a prior art phased array antenna can be described as follows. The input to each waveguide of FIG. 1 is excited with the fundamental mode of the input waveguides. The signal supplied to each waveguide is initially uncoupled from the signals supplied to the other waveguides and at a separate phase, such that a constant phase difference $\phi$ is produced between adjacent waveguides. For example, in FIG. 1, waveguide 101 could be excited with a signal at zero phase, waveguide 102 with the same signal, at 5° phase, waveguide 103 with the same signal at 10° phase, and so forth for the remaining waveguides in the array (not shown). This would imply a phase difference of 5° between any two adjacent waveguides. The input wave produced by this excitation is known as the fundamental Bloch mode, or linear phase progression excitation. When the input excitation is the fundamental Bloch mode, the output from the waveguide array, part of which is illustrated in FIG. 3, will be a series of plane waves, e.g., at directions $\theta_0, \theta_1$ and $\theta_2$, each in a different direction, where the direction of the $m^{th}$ plane wave is specified by:

$$k\sin(\theta_m) = k\sin(\theta_0) + m\left[\frac{2\pi}{a}\right] \tag{2}$$

and the wavefront radiated in the direction of $\theta_0$ is the only wavefront in the central Brillouin zone and is specified by the relationship $\phi = k a \sin(\theta_0)$, $m = \pm 1, \pm 2 \ldots$, and $k = 2\pi/\lambda$ in the medium occupying the positive z plane. The direction of $\theta_0$, and consequently of all the other plane waves emanating from the waveguide array, can be adjusted by adjusting the phase difference $\phi$ between the inputs to adjacent elements. It can be shown that the fraction of the power radiated at direction $\theta_0$ when the inputs are excited in a linear phase progression is $N(\theta)$, defined previously herein for the case of excitation of only one of the waveguides with the fundamental mode.

The relationship between the response of the array to excitation of a single waveguide with the fundamental mode, and the response of the array to the fundamental Bloch mode can be further understood by way of example. Suppose in a Bloch mode excitation $\phi$ is adjusted according to $\phi = k a \sin \theta_0$ such that $\theta_0$ is 5°.

The power radiated at 5° divided by the total input power $= N(5°)$. However, if only one waveguide is excited, and a response similar to response 201 of FIG. 2 is produced in the Brillouin zone, then at $\theta = 5°$, $P(\theta)_{actual}/P(\theta)_{ideal} = N(5°)$.

The fractional radiated power outside the central Brillouin zone of FIG. 2, or equivalently, the percentage of the power radiated in directions other than $\theta_0$ in FIG. 3, should be minimized in order to maximize performance. In a phased array radar antenna, for example, false detection could result from the power radiated in directions other than then $\theta_0$. It can be shown that the wavefront in the direction $\theta_1$ of FIG. 3 comprises most of the unwanted power. Thus, it is a goal of many prior art waveguide arrays, and of this invention, to eliminate as much as possible of the power radiated in the $\theta_1$ direction, and thus provide a high efficiency waveguide array.

Prior art waveguide arrays have attempted to attain the goal stated above in several ways. One such prior art array is described in N. Amitay et al., *Theory and Analysis of Phased Array Antennas*, New York, Wiley Publisher, 1972, at pp. 10–14. The array achieves the goal by setting the spacing between the waveguide centers equal to $\lambda/2$ or less. This forces $\gamma$ to be at least 90°, and thus the central order Brillouin zone occupies the entire real space in the positive z plane of FIG. 1. This method, however, makes it difficult to aim the beam in a narrow desired direction, even with a large number of waveguides. The problem that remains in the prior art is to provide a waveguide array which, when excited with a Bloch mode, can confine a large portion of its radiated power to the direction $\theta_0$ without using a large number of waveguides. Equivalently, the problem is to provide a waveguide array such that when one waveguide is excited with the fundamental mode, a large portion of the radiated power will be uniformly distributed over the central Brillouin zone.

SUMMARY OF THE INVENTION

The foregoing problem in the prior art has been solved in accordance with the present invention which relates to a highly efficient waveguide array formed by shaping each of the waveguides in an appropriate manner, or equivalently, aligning the waveguides in accordance with a predetermined pattern. The predetermined shape or alignment serves to gradually increase the coupling between each waveguide and the adjacent waveguides as the wave propagates through the waveguide array towards the radiating end of the array. The efficiency is maintained regardless of waveguide spacing.

DETAILED DESCRIPTION

Figure 1:
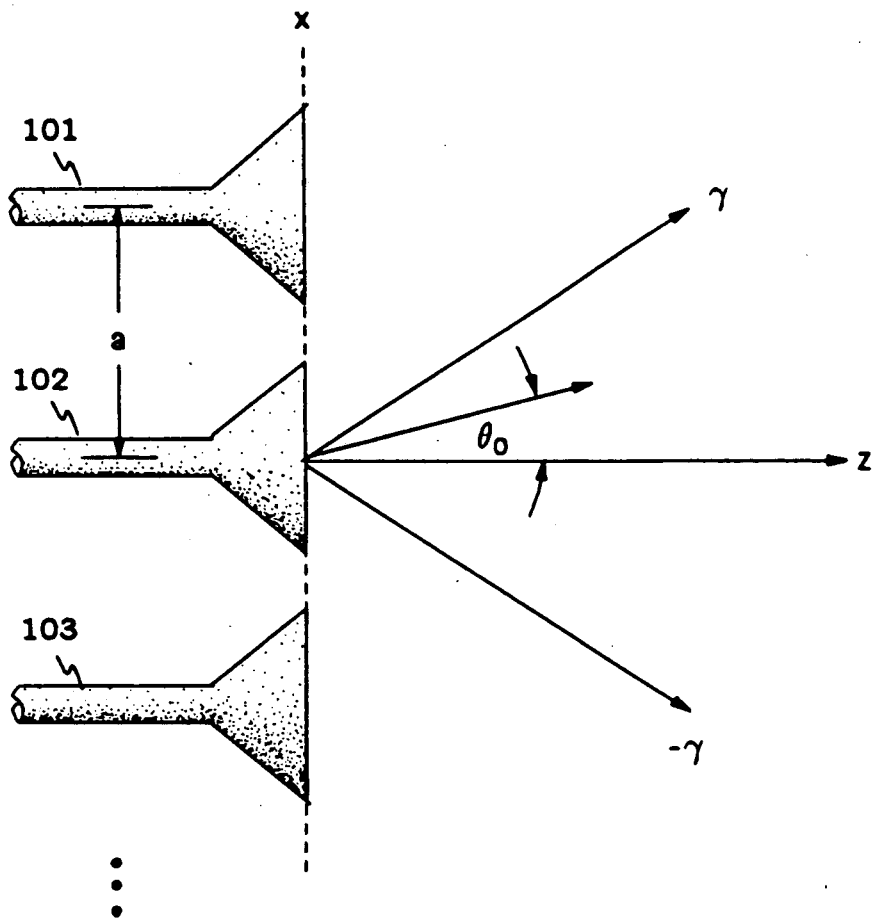
FIG.1 PRIOR ART
FIG. 1 shows an exemplary waveguide array of the prior art.
Figure 2:
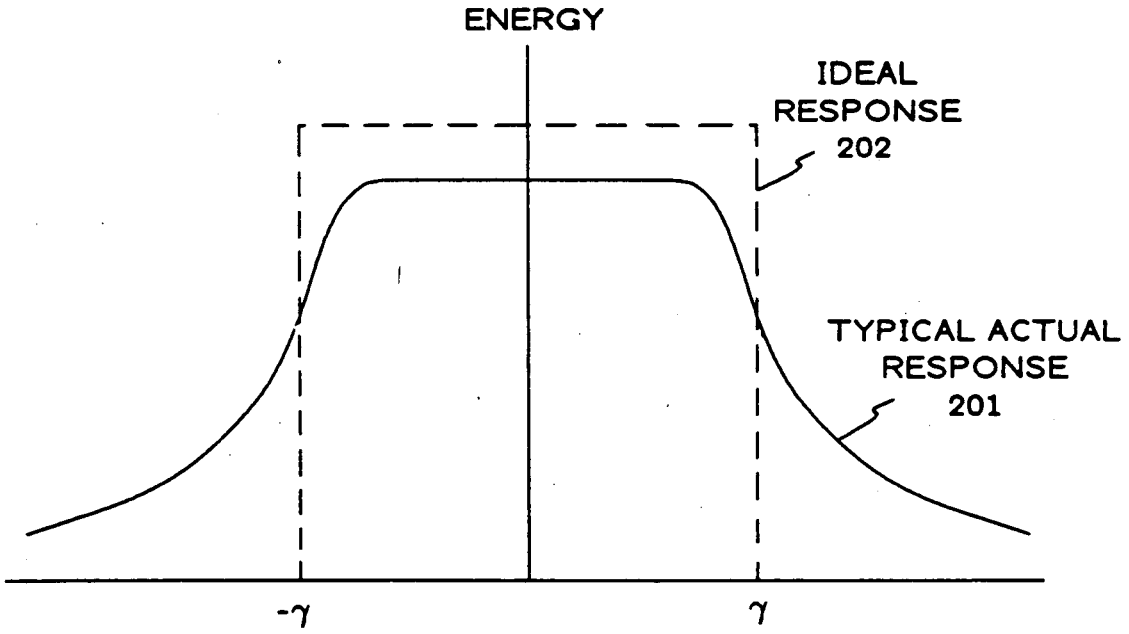
FIG.2 PRIOR ART
FIG. 2 shows the desired response and a typical actual response to the excitation of a single waveguide in the array of FIG. 1.
Figure 4:
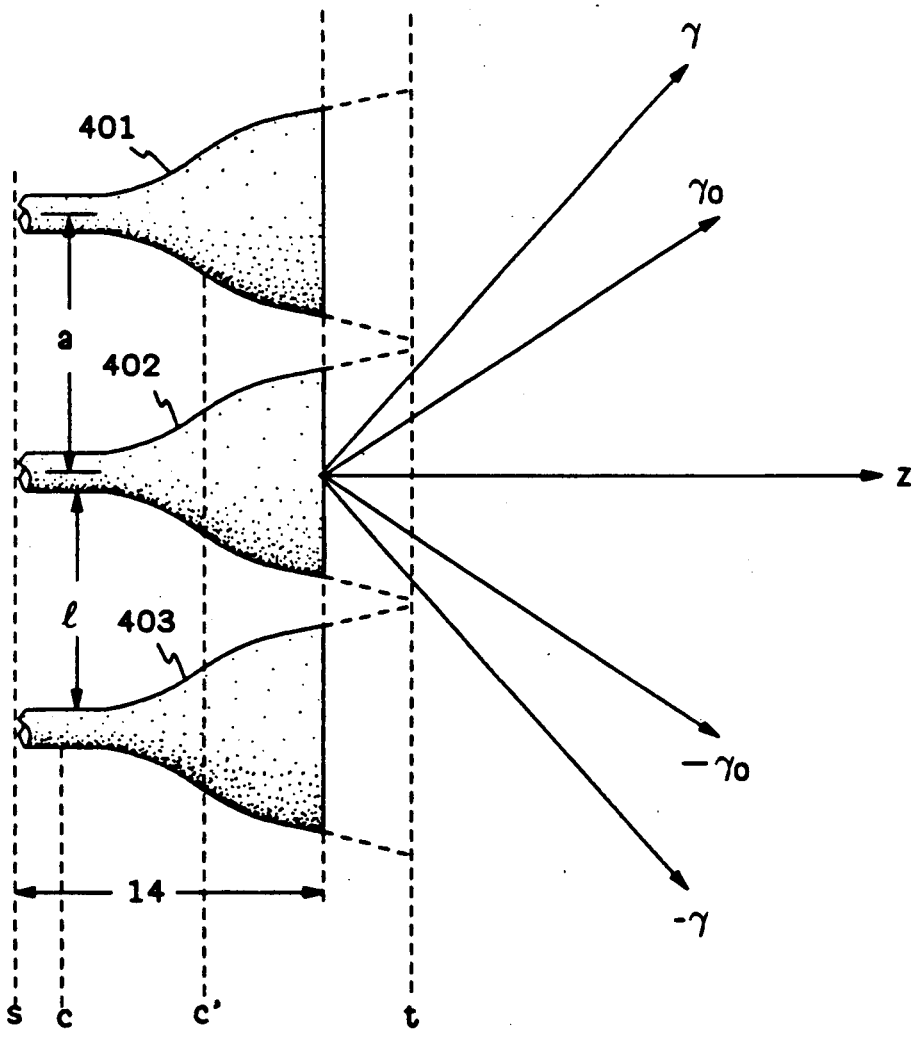
FIG. 4 shows an exemplary waveguide array in accordance with the present invention.
Figure 5:
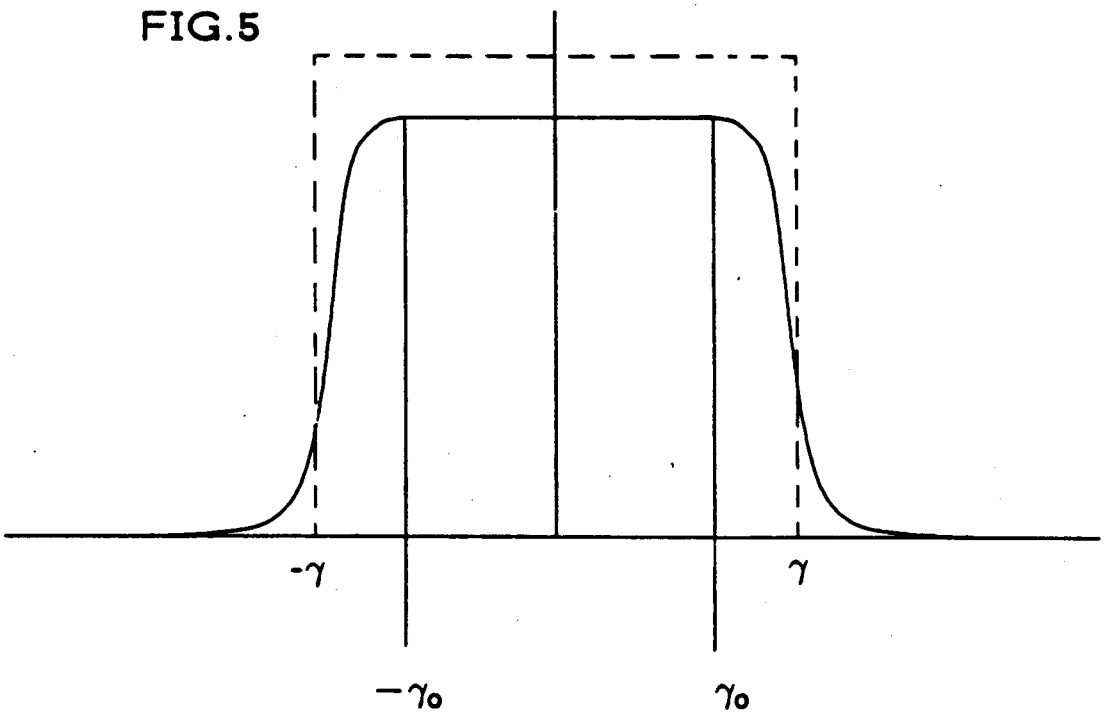
FIG. 5 shows the response to the waveguide array of FIG. 4 as compared to that of an ideal array.

FIG. 4 shows a waveguide array in accordance with the present invention comprising three waveguides 401–403. The significance of the points z=s,t,c, and c' will be explained later herein, as will the dashed portion of the waveguides to the right of the apertures of the waveguides at the x axis. In practical arrays, it is impossible to achieve perfect performance throughout the central Brillouin zone. Therefore, a $\gamma_0$ is chosen, and represents some field of view within the central Brillouin zone over which it is desired to maximize performance. As will be shown hereinafter, the choice of $\gamma_0$ will effect the level to which performance can be maximized. A procedure for choosing the "best" $\gamma_0$ is also discussed hereafter. FIG. 5 shows the response curve of FIG. 2, with an exemplary choice of $\gamma_0$. Assuming $\gamma_0$ has been chosen, the design of the array is more fully described below.

Figure 3:
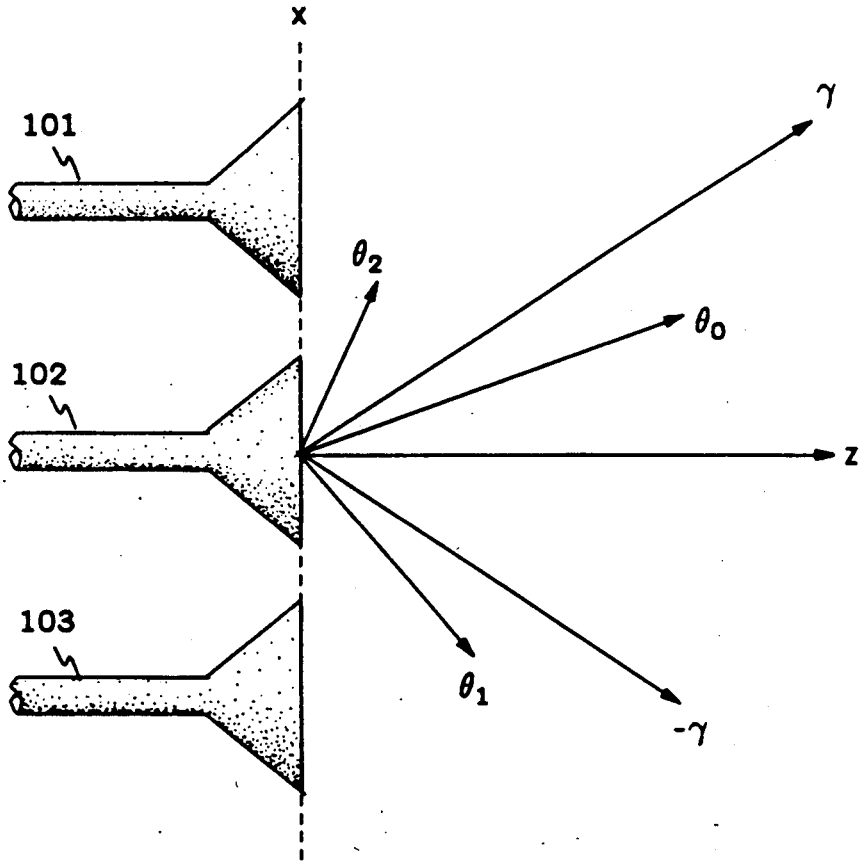
FIG.3 PRIOR ART
FIG. 3 shows a typical response to the excitation of all the waveguides of FIG. 1 in a Bloch mode.

Returning to FIG. 3, as the fundamental Bloch mode propagates in the positive z direction through the waveguide array, the energy in each waveguide is gradually coupled with the energy in the other waveguides. This coupling produces a plane wave in a specified direction which is based on the phase difference of the input signals. However, the gradual transition from uncoupled signals to a plane wave also causes unwanted higher order Bloch modes to be generated in the waveguide array, and each unwanted mode produces a plane wave in an undesired direction. The directions of these unwanted modes are specified by Equation (2) above. These unwanted plane waves, called space harmonics, reduce the power in the desired direction. The efficiency of the waveguide array is substantially maximized by recognizing that most of the energy radiated in the unwanted directions is radiated in the direction of $\theta_1$. As described previously, energy radiated in the direction of $\theta_1$ is a direct result of energy converted to the first higher order Bloch mode as the fundamental Bloch mode propagates through the waveguide array. Thus, the design philosophy is to minimize the energy transferred from the fundamental Bloch mode to the first higher order Bloch mode, denoted the first unwanted mode, as the energy propagates through the waveguide array. This is accomplished by taking advantage of the difference in propagation constants of the fundamental mode and the first unwanted mode.

The gradual taper in each waveguide, shown in FIG. 4, can be viewed as an infinite series of infinitely small discontinuities, each of which causes some energy to be transferred from the fundamental mode to the first unwanted mode. However, because of the difference in propagation constants between the two modes, the energy transferred from the fundamental mode to the first unwanted mode by each discontinuity will reach the aperture end of the waveguide array at a different phase. The waveguide taper should be designed such that the phase of the energy shifted into the first unwanted mode by the different discontinuities is essentially uniformly distributed between zero and $2\pi$. If the foregoing condition is satisfied, all the energy in the first unwanted mode will destructively interfere. The design procedure for the taper is more fully described below.

Figure 6:
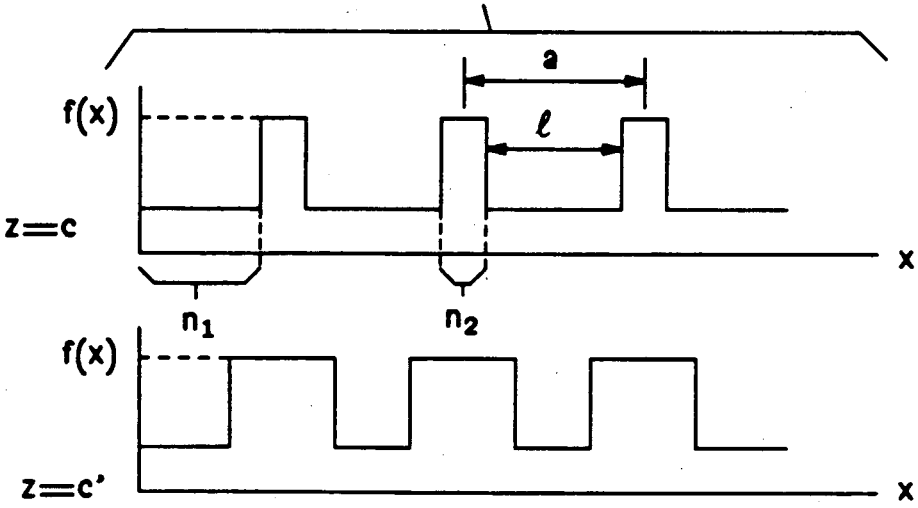
FIG. 6 shows, as a function of x, the refractive space profiles of the waveguide array in two separate planes orthogonal to the longitudinal axis.

FIG. 6 shows a plot of the function $$n^2a^2\left[\frac{2\pi}{\lambda}\right]^2$$

as a function of x at the points z=c and z=c' of FIG. 4, where n is the index of refraction at the particular point in question along an axis parallel to the x axis at points c and c' of FIG. 4, and z is the distance from the radiating end of the array. For purposes of explanation, each of the graphs of FIG. 6 is defined herein as a refractive-space profile of the waveguide array. The designations n1 and n2 in FIG. 6 represent the index of refraction between waveguides and within waveguides respectively. Everything in the above expression is constant except for n, which will oscillate up and down as the waveguides are entered and exited, respectively. Thus, each plot is a periodic square wave with amplitude proportional to the square of the index of refraction at the particular point in question along the x axis. Note the wider duty cycle of the plot at z=c', where the waveguides are wider. Specifying the shape of these plots at various closely spaced points along the z-axis, uniquely determines the shape of the waveguides to be used. Thus, the problem reduces to one of specifying the plots of FIG. 6 at small intervals along the length of the waveguide. The closer the spacing of the intervals, the more accurate the design. In practical applications, fifty or more such plots, equally spaced, will suffice.

Referring to FIG. 6, note that each plot can be expanded into a Fourier series $$n^2a^2\left[\frac{2\pi}{\lambda}\right]^2 = V_0 + \sum_{s\neq 0} V_s e^{-j2\pi sx/a} \tag{3}$$

Of interest is the coefficient of the lowest order Fourier term $V_1$ from the above sum. The magnitude of $V_1$ is denoted herein as V(z).

V(z) is of interest for the following reasons: The phase difference v between the first unwanted mode produced by the aperture of the waveguide array and the first unwanted mode produced by a section dz located at some arbitrary point along the waveguide array is $$\int (B_0 - B_1)dz. \tag{4}$$

where the integral is taken over the distance from the arbitrary point to the array aperture, and $B_0$ and $B_1$ are the propagation constants of the fundamental and first unwanted mode respectively. The total amplitude of the first unwanted mode at the array aperture is $$\tau = \int_0^{v_L} t\exp(jv)dv \tag{5}$$

where $v_L$ is given by Equation (4) evaluated for the case where dz is located at the input end of the waveguide array, i.e., the point z=s in FIG. 4, and t is given as $$t = \frac{a}{2}\ \frac{B_0(\sin\gamma)^2}{4\pi^4(\sin\gamma - \sin\theta)^2}\ \frac{dV(z)}{dz}\ \frac{1}{(1+u^2)^{3/2}} \tag{6}$$

where $$u = \frac{\sin\gamma}{2\pi^2\,[\sin\gamma - \sin\theta]}\,[V(z)] \tag{7}$$

and $\theta$ is an arbitrary angle in the central Brillouin zone, discussed more fully hereinafter. Thus, from equations 5-7, it can be seen that the total power radiated in the $\theta$ direction, is highly dependent on V(z). Further, the efficiency $N(\theta)$ previously discussed can be represented as $$N(\theta) = \frac{1}{1 - |\tau|^2} \tag{8}$$

This is the reason V(z) is of interest to the designer, as stated above.

In order to maximize the efficiency of the array, the width of the waveguides, and thus the duty cycle in the corresponding plot, V(z) should be chosen such that at any point z along the length of the waveguide array, V(z) substantially satisfies the relationship $$V(z) = 2\pi^2\left[\frac{\sin\gamma - \sin\theta_B}{\sin\gamma}\right]\left[\frac{p(y)}{\sqrt{1 - p^2(y)}}\right] \tag{9}$$

where $$p(y) = \frac{3}{2}\,y\left(1 - \frac{1}{3}\,y^2\right) \tag{10}$$

$$y = F_r\left(\frac{|z|}{L}\right) + F_t,$$

L is the length of the waveguide after truncating, i.e., excluding the dashed portion in FIG. 4, $F_r$ and $F_t$ are the fractions of the waveguide remaining and truncated, respectively. More particularly, the length of the waveguide before truncation would include the dashed portion of each waveguide, shown in FIG. 4. This can be calculated easily since, at the point when the waveguides are tangent, (z=t in FIG. 4), V(z) will equal 0 as the plot $$n^2a^2\left[\frac{2\pi}{\lambda}\right]^2$$

is a constant. Thus, by finding the leftmost point z=t along the z axis such that V=0, one can determine the length before truncation. The length after truncation will be discussed later herein, however, for purposes of the present discussion, $F_t$ can be assumed zero, corresponding to an untruncated waveguide. It can be verified that $$V(z) = \frac{(n_1 + n_2)(n_1 - n_2)}{4\pi}\,k^2a^2\sin\left(\frac{l(z)\pi}{a}\right) \tag{11}$$

where $n_1$=index of refraction in the waveguides, $n_2$=index of refraction in the medium between the waveguides, and l is the distance between the outer walls of two adjacent waveguides as shown in FIG. 4. Thus, from equations (9) and (11), $$2\pi^2\left[\frac{\sin\gamma - \sin\theta_B}{\sin\gamma}\right]\left[\frac{p(y)}{\sqrt{1 - p^2(y)}}\right] = \frac{(n_1 + n_2)(n_1 - n_2)}{4\pi}\,k^2a^2\sin\left(\frac{l(z)\pi}{a}\right) \tag{12}$$

Thus, after specifying $\theta_B$ and $\gamma_0$, and, assuming that $F_t$=0, Equation 12 can be utilized to specify l(z) at various points along the z axis and thereby define the shape of the waveguides.

Throughout the previous discussion, three assumptions have been made. First, it has been assumed that $\gamma_0$ was chosen prior to the design and the efficiency was maximized over the chosen field of view. Next, $\theta_B$ was assumed to be an arbitrary angle in the central Brillouin zone. Finally, $F_t$ was assumed to be zero, corresponding to an untruncated waveguide. In actuality, all of these three parameters interact in a complex manner to influence the performance of the array. Further, the performance may even be defined in a manner different from that above. Therefore, an example is provided below of the design of a star coupler. It is to be understood that the example given below is for illustrative purposes of demonstrating the design procedure may be utilized in a wide variety of other applications.

One figure of merit, M, for an optical star coupler is defined as $$M = N^2(\gamma_0)\,\frac{\sin\gamma_0}{\sin\gamma} \tag{13}$$

To maximize M, the procedure is as follows: Assume $F_t$=0, choose an arbitrary $\theta_B$, and calcualte $N(\theta)$ using equations 5-8, for all angles $\theta$ within the Brillouin zone. Having obtained these values of $N(\theta)$, vary $\gamma_0$ between zero and $\gamma$ to maximize M. This gives the maximum M for a given $F_t$ and a given $\theta_B$. Next, keeping $F_t$ equal to zero, the same process is iterated using various $\theta_B$'s until every $\theta_B$ within the Brillouin zone has been tried. This gives the maximum M for a given $F_t$ over all $\theta_B$s. Finally, iterate the entire process with various $F_t$'s until the maximum M is achieved over all $\theta_B$s and $F_t$s. This can be carried out using a computer program.

Figure 7:
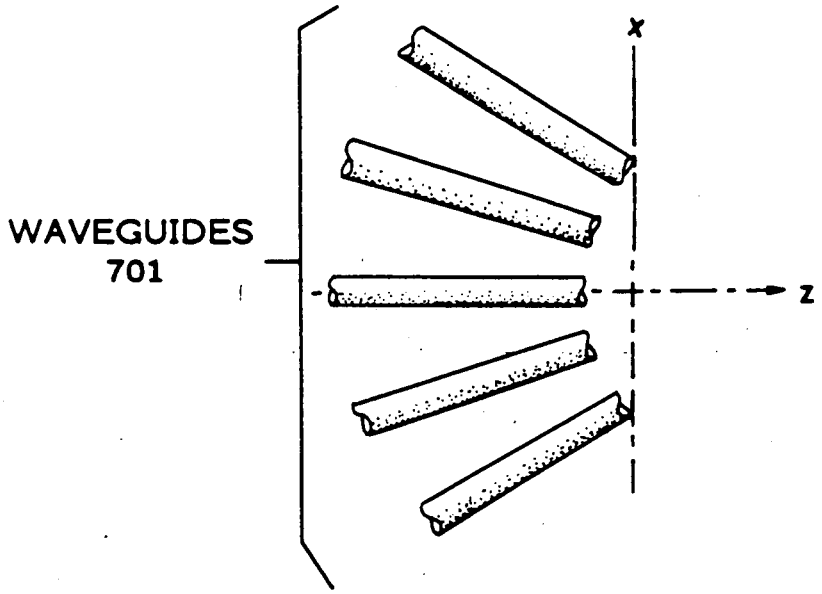
FIG. 7 shows an alternative embodiment of the inventive waveguide array.

It should be noted that the example given herein is for illustrative purposes only, and that other variations are possible without violating the scope or spirit of the invention. For example, note from equation 12 that the required property of V(z) can be satisfied by varying "a" as the waveguide is traversed, rather than varying l as is suggested herein. Such an embodiment is shown in FIG. 7, and can be designed using the same methodology and the equations given above. Further, the value of the refractive index, n, could vary at different points in the waveguide cross-section such that equation (12) is satisfied. Applications to radar, optics, microwave, etc. are easily implemented by one of ordinary skill in the art.

The invention can also be implemented using a two-dimensional array of waveguides, rather than the one-dimensional array described herein. For the two-dimensional case, equation (3) becomes $$n^2 a_x^2 \left[ \frac{2\pi}{\lambda} \right]^2 = \sum_{\text{all } f,g} V_{f,g} \exp\left[ -j2\pi \left( \frac{fx}{a_x} + \frac{gy}{a_y} \right) \right] \quad (14)$$

where $a_x$ is the spacing between waveguide centers in the x direction, and $a_y$ is the spacing between waveguide centers in the y direction. The above equation can then be used to calculate $V_{1,0}$, the first order Fourier coefficient in the x direction. Note from equation (14) that this coefficient is calculated by using a two-dimensional Fourier transform. Once this is calculated, the method set forth previously can be utilized to maximize the efficiency in the x direction. Next, $a_x$ in the left side of equation (14) can be replaced by $a_y$, the spacing between waveguide centers in the second dimension, and the same methods applied to the second dimension.

The waveguides need not be aligned in perpendicular rows and columns of the x,y plane. Rather, they may be aligned in several rows which are offset from one another or in any planar pattern. However, in that case, the exponent of the two-dimensional Fourier series of equation (14) would be calculated in a slightly different manner in order to account for the angle between the x and y axes. Techniques for calculating a two-dimensional Fourier series when the basis is not two perpendicular vectors are well-known in the art and can be used to practice this invention.

I claim:

1. A waveguide array including an associated efficiency and comprising:

a plurality of waveguides, each waveguide including an input port at a first end thereof for receiving electromagnetic energy, and an output port at a second end thereof for launching the electromagnetic energy, the waveguide array including a predetermined series of refractive-space profiles arranged at spaced-apart locations across the waveguide array, each refractive-space profile including a separate Fourier series expansion which comprises a lowest order Fourier term that is determined to substantially maximize the associated efficiency of the waveguide array, whereby said lowest order Fourier term, denoted $V_{(z)}$, is defined by $$V_{(z)} = 2\pi^2 \left[ \frac{\sin\gamma - \sin\theta_B}{\sin\gamma} \right] \left[ \frac{p(y)}{\sqrt{1 - p^2(y)}} \right]$$

where $\theta_B$ is an arbitrary angle within a predetermined range of angles defined by a minimum and maximum angle, $\gamma$ is the maximum angle, $$p(y) = \frac{3}{2} y \left( 1 - \frac{1}{3} y^2 \right),$$

$$y = F_r \left( \frac{|z|}{L} \right) + F_l,$$

L is a predetermine length of each waveguide, $|z|$ is a perpendicular distance between the refractive space profile and the second end of the waveguide, $F_r$ is equal to $L/(L+b)$, b is a perpendicular distance which an outer surface of each waveguide would have to be extended in order to become tangent to an outer surface of an adjacent waveguide, and $F_l = 1 - F_r$.

2. A waveguide array according to claim 1 wherein the waveguides are all aligned substantially parallel to each other in a predetermined direction, and wherein the input ports of all the waveguides substantially define a first plane substantially normal to the predetermined direction, and the output ports of all the waveguides substantially define a second plane substantially normal to the predetermined direction, and each waveguide comprises a diameter which varies along said predetermined direction such that a predetermined criteria is substantially satisfied.

3. A waveguide array according to claim 1 wherein the waveguides are aligned substantially radially with each other, and wherein the input ports of the waveguides substantially define a first arc and the output ports of the waveguides substantially define a second arc, substantially concentric to and larger than the first arc, such that a predetermined criteria is substantially satisfied.

4. A waveguide array according to claim 1 wherein each waveguide includes a predetermined index of refraction which varies along the predetermined direction such that a predetermined criteria is substantially satisfied.

5. A waveguide array according to claim 1, 2, 3 or 4 wherein the length of each waveguide is chosen in accordance with a predetermined criteria such that the efficiency of the waveguide array is substantially maximized.

6. A waveguide array according to claim 5 wherein the plurality of waveguides are arranged in a A×B two-dimensional array where A and B are separate arbitrary integers.

7. A waveguide array according to claim 1, 2, 3 or 4 wherein the plurality of waveguides are arranged in an A×B two-dimensional array where A and B are separate arbitrary integers.

* * * * *